US011617408B2

(12) United States Patent
Lu

(10) Patent No.: US 11,617,408 B2
(45) Date of Patent: Apr. 4, 2023

(54) PIVOTING SHIELD ASSEMBLY FOR HAT

(71) Applicant: Chien-Hung Lu, Tainan (TW)

(72) Inventor: Chien-Hung Lu, Tainan (TW)

( * ) Notice: Subject to any disclaimer, the term of this patent is extended or adjusted under 35 U.S.C. 154(b) by 191 days.

(21) Appl. No.: 17/316,831

(22) Filed: May 11, 2021

(65) Prior Publication Data

US 2022/0361620 A1 Nov. 17, 2022

(51) Int. Cl.
*A42B 3/22* (2006.01)

(52) U.S. Cl.
CPC ..... *A42B 3/223* (2013.01); *A42B 3/22* (2013.01); *A42B 3/221* (2013.01); *A42B 3/222* (2013.01)

(58) Field of Classification Search
CPC ..... A42B 3/223; A42B 3/22; A42B 3/221; A42B 3/222
See application file for complete search history.

(56) References Cited

U.S. PATENT DOCUMENTS 4,109,320 A * 8/1978 Anderson ..... A61F 9/06 2/10
4,479,738 A * 10/1984 Kubnick ..... A61F 9/06 2/10
5,012,528 A * 5/1991 Pernicka ..... A42B 3/225 2/10
5,373,583 A * 12/1994 Birum ..... A61F 9/02 2/10
8,321,962 B2 * 12/2012 Moyses ..... A42B 3/225 2/5
9,516,911 B2 * 12/2016 Happel ..... A42B 3/225
11,058,586 B2 * 7/2021 Sommers ..... A61F 9/06
11,064,755 B1 * 7/2021 Williams ..... A42B 3/0406
11,160,323 B2 * 11/2021 Sanders ..... A42B 1/0188
11,213,089 B2 * 1/2022 Bohn ..... A42B 3/225
2004/0199982 A1 * 10/2004 Wang-Lee ..... A42B 3/225 2/10
2013/0031693 A1 * 2/2013 Gleason ..... A42B 3/225 2/9
2015/0264992 A1 * 9/2015 Happel ..... A42B 3/04 2/422
2020/0383417 A1 * 12/2020 Bohn ..... A42B 3/225
2021/0307448 A1 * 10/2021 Sanders ..... A42B 3/225
2021/0315302 A1 * 10/2021 Philibert ..... A42B 3/04
2022/0047033 A1 * 2/2022 Zeilinger ..... A42B 3/227
2022/0361620 A1 * 11/2022 Lu ..... A42B 3/221

* cited by examiner

*Primary Examiner* — Khaled Annis

(57) ABSTRACT

A pivoting shield assembly for hats is revealed. The pivoting shield assembly includes mounting slots arranged at two sides of a hat, a pivot base mounted to each mounting slot, a first connecting rod and a second connecting rod each of which having one end pivotally connected to the pivot base and the other end pivotally mounted to a shield, and a pathway groove disposed on an inner side of the first connecting rod. The pivot base includes an elastic locking piece which is mounted and moveable in the pathway groove correspondingly. Thereby lifting up and pulling down of the shield are more precise and having different stages. The pivoting shield assembly for hats is practical.

7 Claims, 10 Drawing Sheets

PIVOTING SHIELD ASSEMBLY FOR HAT

BACKGROUND OF THE INVENTION

Field of the Invention

The present invention relates to a pivoting shield assembly for hats, especially to a pivoting shield assembly applied to various hats installed with shields. By movement of the shield along pathway grooves, lifting up and pulling down of the shield are smoother.

Description of Related Art

There are many different types of hats designed for protection of heads such as helmets, hard hats, etc. The hard hat used in workplace environments such as industrial or construction sites is equipped with a protective shield arranged and positioned on two sides thereof in order to protect user's eyes and face from injuries. The hard hats provided with the protective shield are divided into many types. One of them consists of threaded fasteners for positioning the protective shield on left and right sides thereof to cover the head, the eyes, and the face. Helmets are an essential piece of safety equipment for motorcyclists. Besides head protection, most of the helmets are provided with a protective shield able to be moved up and down easily for protecting users' eyes and face from foreign objects and bad weather such as wind, rain, etc. Although the shield on the helmet can be rotated up and down freely, the shield may be projected from the top of the hat while being lifted to the top of the hat because each side of the conventional shield and the hat is pivotally connected at a single pivot point and the shield is rotated around the pivot point with the width of the shield as the radius. While riding the motorcycle, more surface area is created by the shield for the oncoming wind to push against and this may cause safety issues.

Thus there is room for improvement and there is a need to provide a novel pivoting shield assembly for hats which is more convenient to use.

SUMMARY OF THE INVENTION

Therefore, it is a primary object of the present invention to provide a pivoting shield assembly for hats, especially a pivoting shield assembly applied to various hats installed with shields. By the movement of the shield along pathway grooves, the shield is lifted up and pulled down more precisely. The assembly is more practical in use.

In order to achieve the above object, a pivoting shield assembly for hats according to the present invention mainly includes at least one mounting slot arranged at each of two sides of a hat, a pivot base movably mounted to the mounting slot, a first connecting rod and a second connecting rod each of which having one end pivotally connected to the pivot base and the other end pivotally mounted to a shield, and a pathway groove disposed on an inner side of the first connecting rod. The pivot base is provided with an elastic locking piece which is mounted and moveable in the pathway groove correspondingly. Thereby lifting up and pulling down of the shield are more precise and having different stages. The pivoting shield assembly for hats is practical.

Preferably, the pathway groove consists of a first path, a second path adjacent to the first path, and a guiding wall located between the first and the second paths.

Preferably, one end of the first path and one end of the second path are overlapped and connected to each other while the second path is lower than the first path. One end of the guiding wall is extended into the first path so that a curved turned segment is formed on the first path while a curved slot is formed at the guiding wall at the position corresponding to a rear end of the curved turned segment. An inclined segment is extended from the rear end of the curved turned segment and connected to the second path.

Preferably, a stopping wall is disposed at the outside of the first path and extended to an outer side of connection area where the first path and the second path are connected. The stopping wall is provided with a stop projection convex toward the first path and corresponding to the curved slot for abutting against the elastic locking piece into the curved slot.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn technical content, features and functions of the present invention more completely and clearly, please refer to the following detailed description with reference to the accompanying figures and reference signs.

Figure 1:
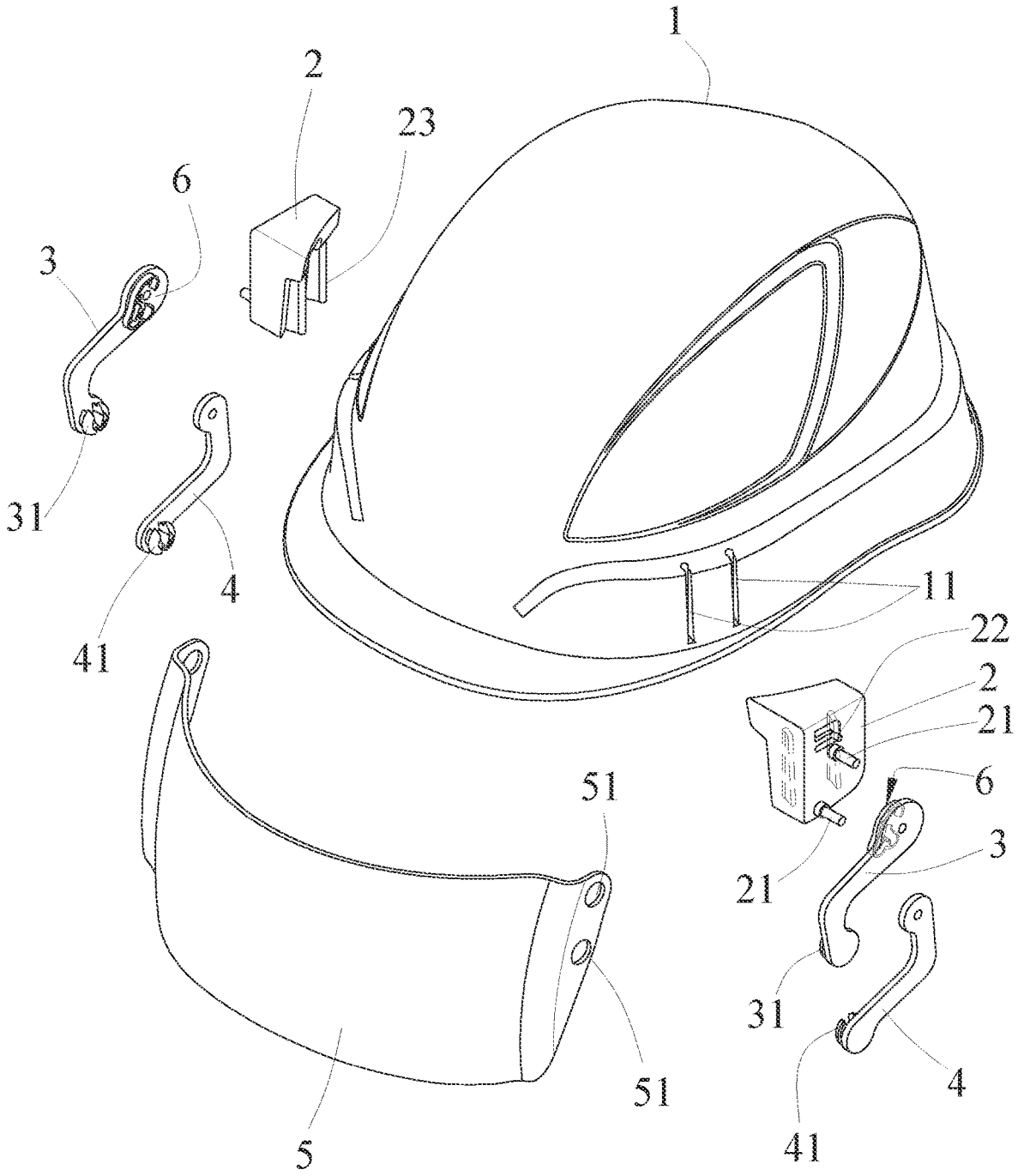
FIG. 1 is an exploded view of an embodiment according to the present invention.
Figure 2:
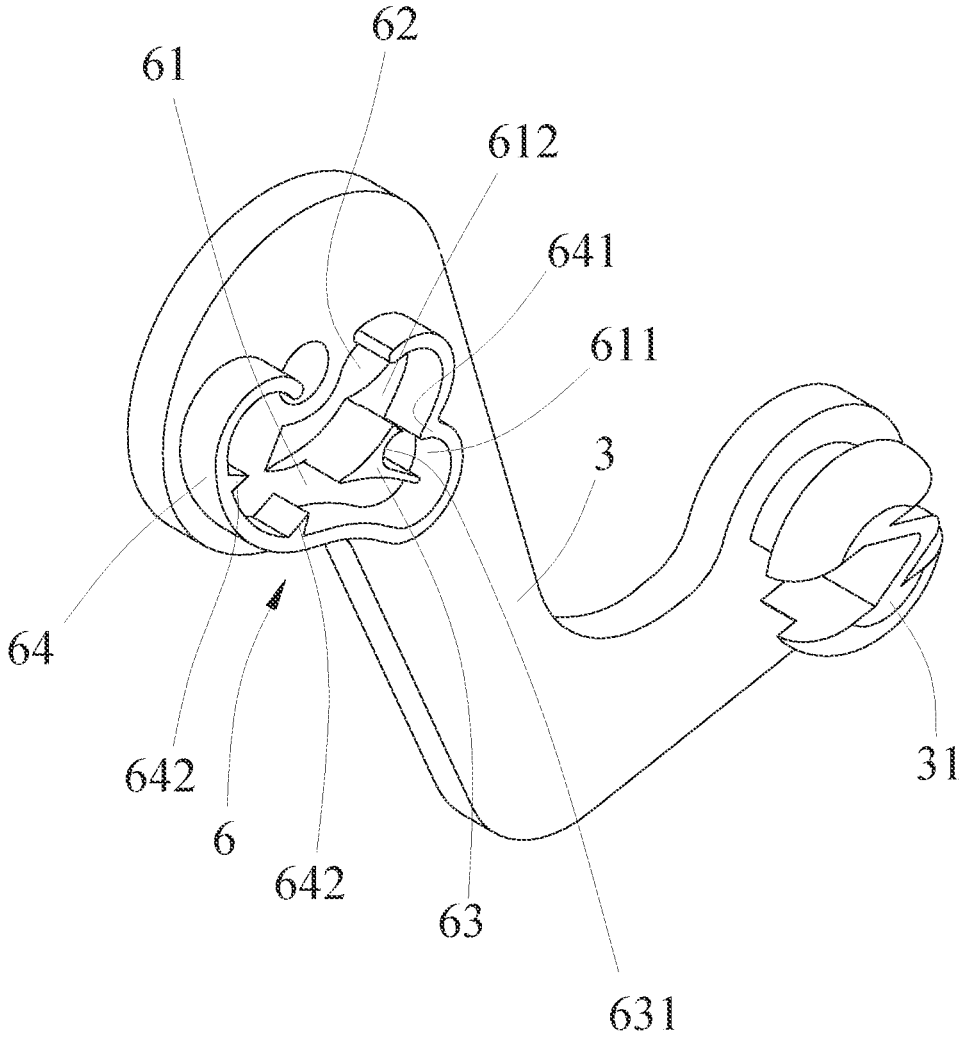
FIG. 2 is a perspective view of a first connecting rod of an embodiment according to the present invention.
Figure 3:
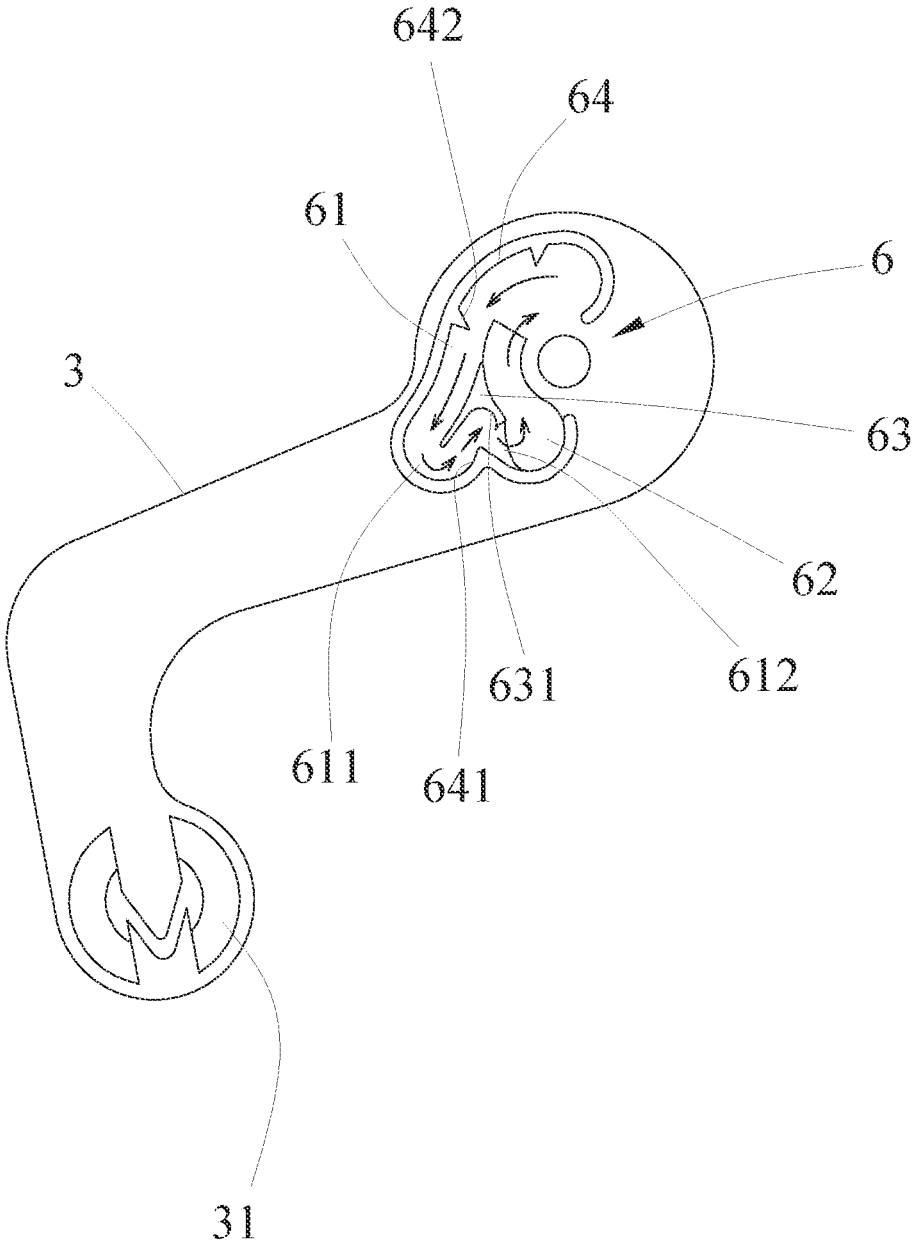
FIG. 3 is a plan view of a first connecting rod of an embodiment according to the present invention.
Figure 4:
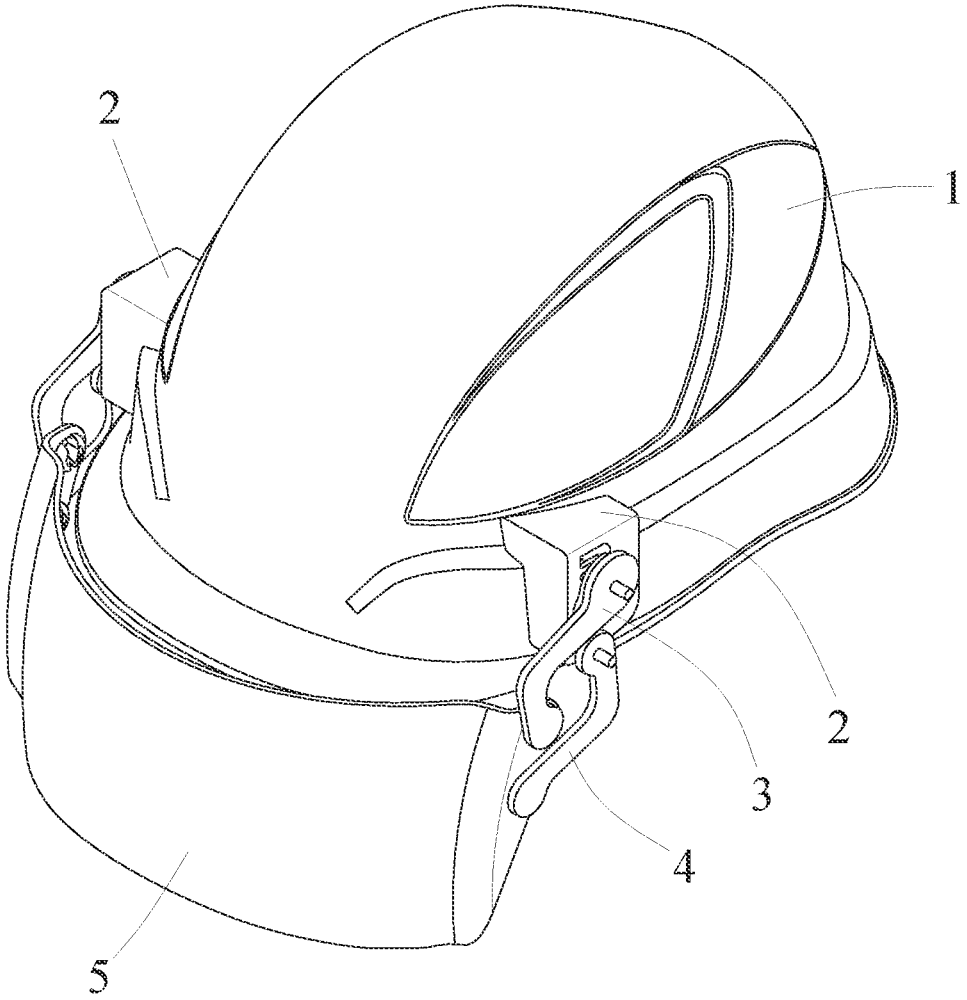
FIG. 4 is a perspective view of an embodiment according to the present invention.
Figure 5:
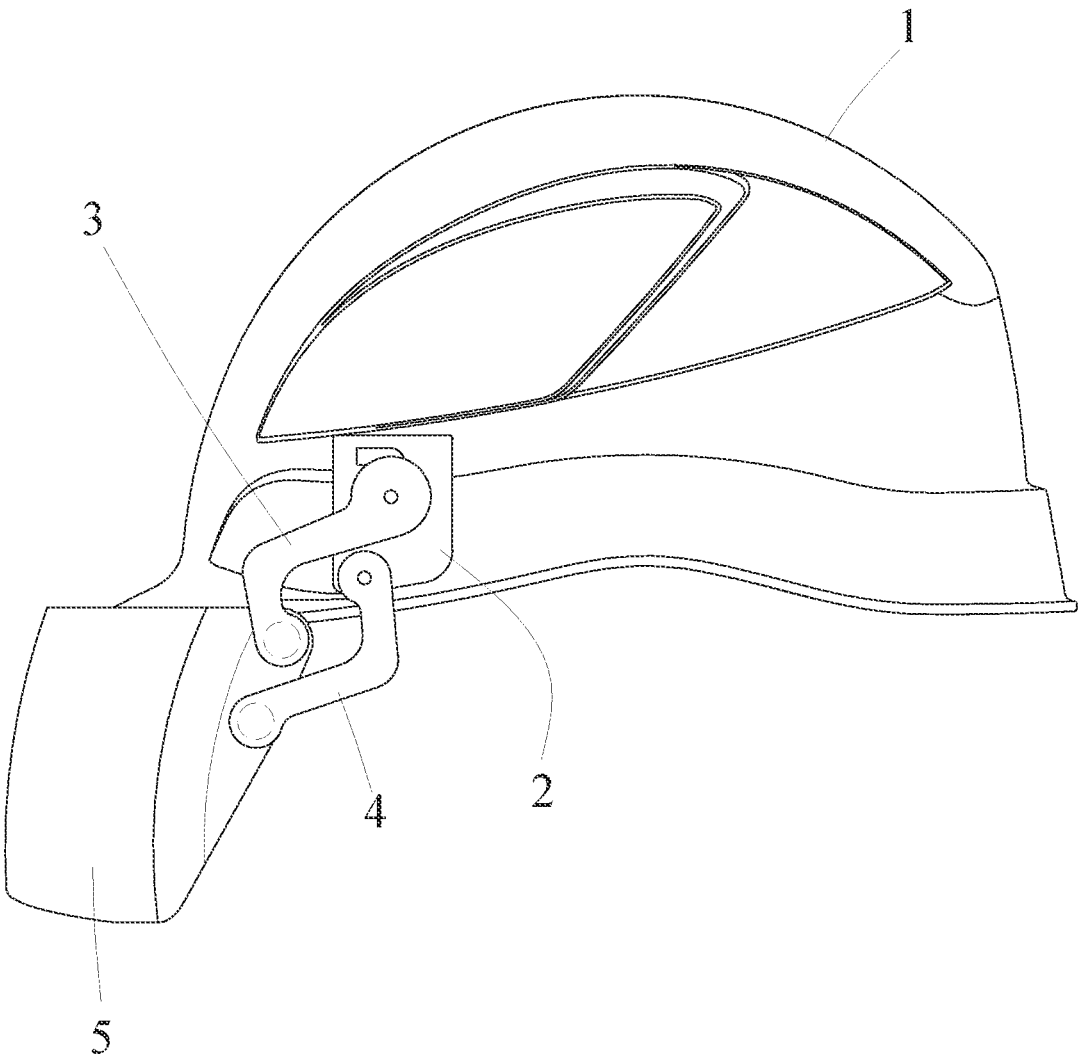
FIG. 5 is a schematic drawing showing an embodiment being pulled down according to the present invention.

Refer to FIGS. 1-4, an exploded view, a perspective view and a plan view of an embodiment of a pivoting shield assembly for hats are revealed. The pivoting shield assembly for hats includes a hat 1, two pivot bases 2, two first connecting rods 3, two second connecting rods 4, a shield 5, and two pathway grooves 6. At least one mounting slot 11 is disposed on each of two sides of the hat 1 and the pivot base 2 is movably mounted to the mounting slot 11. The pivot base 2 is provided with two pivot portions 21 pivotally connected to the first connecting rod 3 and the second connecting rod 4 correspondingly. One end of the first connecting rod 3 and one end of the second connecting rod 4 are respectively provided with a first mounting block 31 and a second mounting block 41 which are pivotally mounted to the shield 5. The pathway groove 6 is arranged at the periphery of an inner side of the first connecting rod 3 while the inner side of the first connecting rod 3 is pivotally connected to the pivot portion 21. The pivot base 2 further includes an elastic locking piece 22 which is mounted and movable in the pathway groove 6 and at least one mounting piece 23 which is corresponding to the mounting slot 11 of the hat 1 for being mounted and connected to each other. As shown in FIG. 2 and FIG. 3, the pathway groove 6 consists of a first path 61, a second path 62 adjacent to the first path 61, a guiding wall 63 located between the first and the second paths 61, 62, and a stopping wall 64 disposed at the outside of the first path 61. One end of the first path 61 and one end of the second path 62 are overlapped and connected to each other while the second path 62 is lower than the first path 61. One end of the guiding wall 63 is extended into the first path 61 so that a curved turned segment 611 is formed on the first path 61 while a curved slot 631 is formed at the guiding wall 63 at the position corresponding to a rear end of the curved turned segment 611. An inclined segment 612 is extended from the rear end of the curved turned segment 611 and connected to the second path 62. The stopping wall 64 is extended to the outside of connection area where the first path 61 and the second path 62 are connected and provided with a stop projection 641 convex toward the first path 61 and corresponding to the curved slot 631 for abutting against the elastic locking piece 22 into the curved slot 631.

As shown in FIGS. 1-4, the present pivoting shield assembly is mainly applied to hard hats, helmets or other hats provided with shields. While being assembled, the first and the second connecting rods 3, 4 are pivotally connected to the pivot base 2. The elastic locking piece 22 is mounted and movable in the pathway groove 6 on the inner side of the first connecting rod 3. Then the mounting piece 23 of the pivot base 2 is movably mounted and connected to the mounting slot 11 of the hat 1 by an easy mounting and locking step. Next the first mounting block 31 and the second mounting block 41 are aligned with and pivotally mounted to two pivot holes 51 of the shield 5 correspondingly (as shown in FIG. 1). When the components mentioned above are worn or damaged, they can be replaced by new ones due to the detachable design and there is no need to throw away the entire hat.

Figure 6:
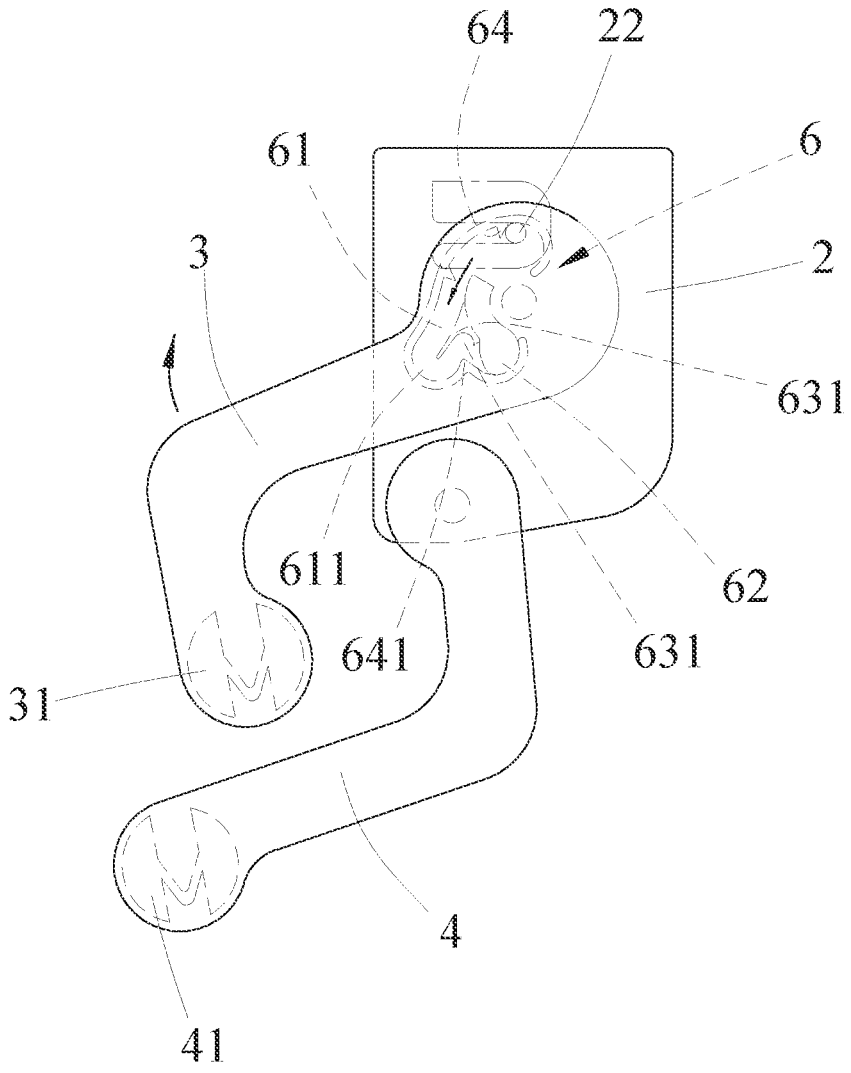
FIG. 6 is a schematic drawing showing movement of two connecting rods of an embodiment while a shield is pulled down according to the present invention.
Figure 7:
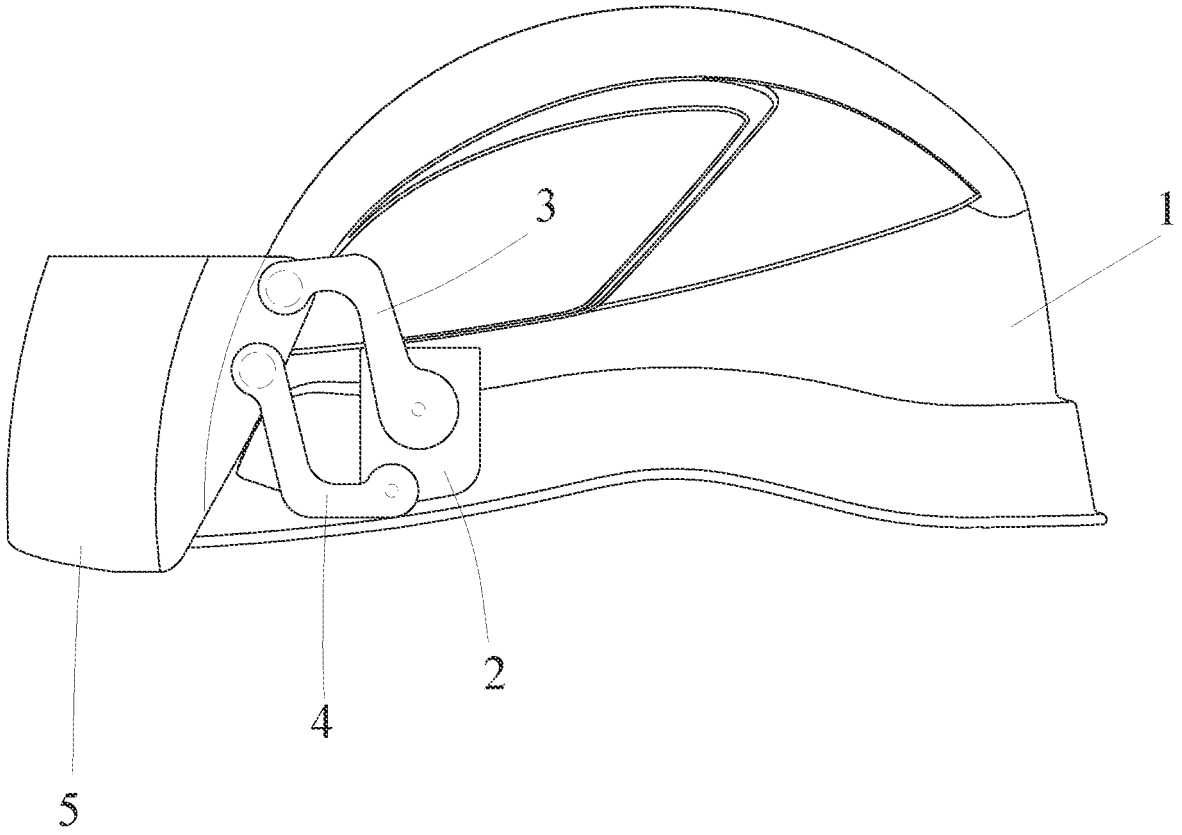
FIG. 7 is a schematic drawing showing an embodiment during a partial lifting of a shield according to the present invention.
Figure 8:
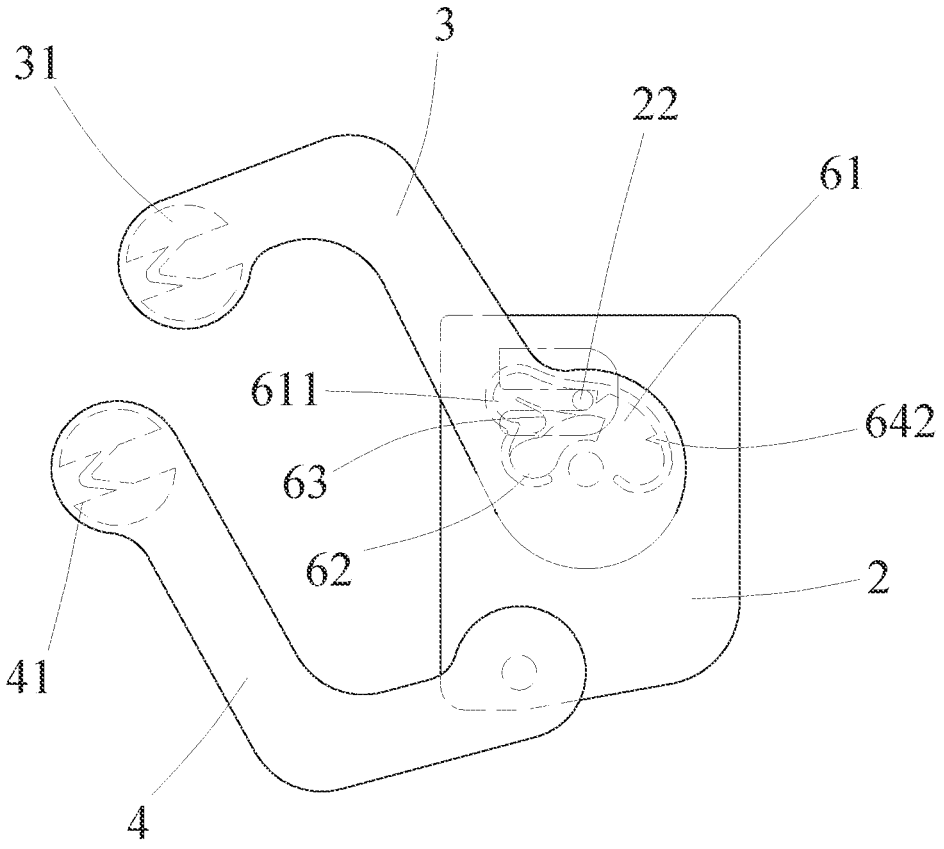
FIG. 8 is a schematic drawing showing movement of two connecting rods of an embodiment during a partial lifting of a shield according to the present invention.

Refer to FIGS. 5-8, while in use, the user wears the above hat 1 and the shield 5 covers the user's face while the elastic locking piece 22 is located at the most-front end of the first path 61 of the pathway groove 6. Now. When the shield 5 is lifted up, the shield 5 drives the first and the second connecting rods 3, 4 to rotate and the elastic locking piece 22 is moved along the first path 61. The stopping wall 64 disposed at the outside of the first path 61 is further provided with a plurality of protruding blocks 642 corresponding to the elastic locking piece 22, as shown in FIG. 8. When the elastic locking piece 22 is moved to one of the protruding blocks 642, the elastic locking piece 22 is limited moderately. That means the angle of the shield 5 being lifted is limited, as shown in FIG. 6 and FIG. 8. Thereby the shield 5 has multi-stage adjustment, able to be lifted to different angles. The elastic locking piece 22 can also be moved across the protruding block 642, without being limited by the protruding block 642, and a "click' warning sound is generated.

Figure 9:
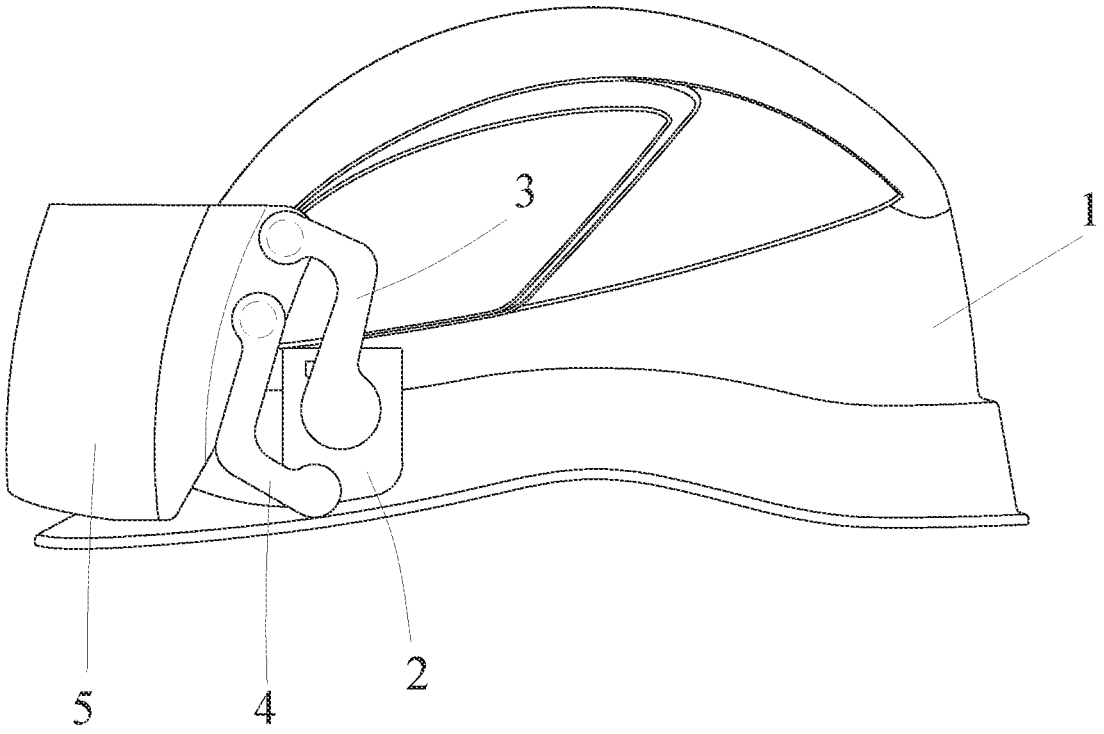
FIG. 9 is a schematic drawing showing an embodiment with a shield lifted-up completely according to the present invention.
Figure 10:
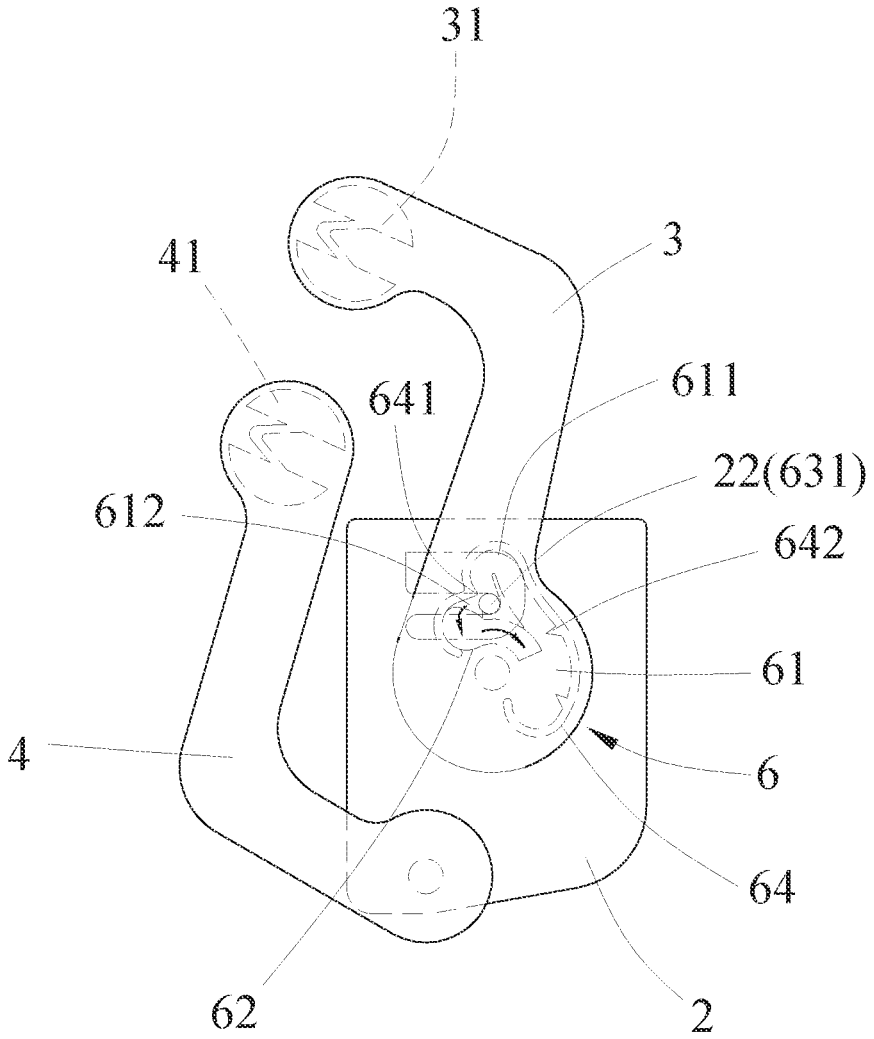
FIG. 10 is a schematic drawing showing movement of two connecting rods an embodiment with a shield lifted-up completely according to the present invention.

As shown in FIGS. 7-10, the shield 5 is moved up further. The shield 5 drives the first and the second connecting rods 3, 4 to rotate and the elastic locking piece 22 is moved along the first path 61, leaning against the guiding wall 63 and entered the curved turned segment 611 of the first path 61. Now the shield 5 is just moved upward and passed through a brim of the hat 1. When the elastic locking piece 22 is turned to the rear end of the curved turned segment 611, it is guided into the curved slot 631 under guidance and limit of the stop projection 641 of the stopping wall 64, without sliding and falling into the inclined segment 612 and then arriving the second path 62. After the elastic locking piece 22 being guided and mounted into the curved slot 631, the lifting and the positioning of the shield 5 at the highest position are completed, as shown in FIG. 9 and FIG. 10.

When the user intends to pull down the shield 5, the shield 5 should be pulled backward a little bit, as the arrows in FIG. 10 indicate. That means the first and the second connecting rods 3, 4 are moved backward a little bit. The movement is like to undo the lock. By elastic margin which space around the elastic locking piece 22 gives, the elastic locking piece 22 is released from the curved slot 631 during the little amount of movement and entered into the second path 62 through the inclined segment 612 for starting the covering of the shield 5. During the pulling down of the shield 5, the elastic locking piece 22 is moved from the second path 62 to the overlapped area between the first path 61 and the second path 62, guided to the front end of the first oath 61, and returned to the original position where the shield 5 covers user's face.

In addition, it should be noted that the angle of the shield 5 with respect to the hat 1 can be adjusted smoothly by the two connecting rods 3, 4 which are pivotally connected to the pivot base 2 on each of two sides of the hat 1 and moved together. The angle can be changed along with the shape of the hat 1 during lifting up of the shield 5 so that the shield 5 is perfectly fit the hat 1 and located adjacent to the hat 1. The first connecting rod 3 and the second connecting rod 4 can be both curved connecting rods, or a combination of a curved connecting rod and a straight connecting rod. Thereby a certain space for angle adjustment is set aside between the two connecting rods to achieve the functions mentioned above.

In summary, the present invention has the following advantages compared with the techniques available now.

1. The pivot bases, the hat, and the shield are connected to each other easily by the simple mounting and locking action. When the above parts are worn or damaged, they can be replaced by new ones due to the detachable design and there is no need to throw away the entire hat. Thereby the present assembly is easy to assembly, practical and cost-effective.
2. The first and second connecting rods can be both curved connecting rods, or a combination of a curved connecting rod and a straight connecting rod. Thereby the angle can be adjusted along with the shape of the hat to make the shield perfectly fit to the hat and locate adjacent to the hat during the lifting up of the shield. The wind resistance problem of the conventional shield can be solved efficiently.
3. By the movement of the shield along the pathway grooves on the connecting rods through the elastic locking pieces, the lifting up and pulling down of the shield are positioned and more precise.
4. By the arrangement of protruding blocks, the elastic locking piece can be limited moderately and the angle of the shield being lifted up is also limited. Thereby the shield has multi-stage adjustment, able to be lifted to different angles.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A pivoting shield assembly for hats comprising:

at least one mounting slot arranged at each of two sides of a hat, a pivot base which is movably mounted to the mounting slot and provided with two pivot portions and an elastic locking piece;

a first connecting rod having one end pivotally connected to one of the pivot portions and the other end provided with a first mounting block for being pivotally mounted to a shield;

a second connecting rod having one end pivotally connected to the other pivot portion and the other end provided with a second mounting block for being pivotally mounted to the shield, and a pathway groove disposed on the periphery of an inner side of the first connecting rod and composed of a first path, a second path arranged adjacent to the first path, and a guiding wall located between the first and the second paths; the inner side being pivotally connected to the pivot portion and the elastic locking piece of the pivot base able to be moved in the pathway groove; wherein one end of the first path and one end of the second path are overlapped and connected to each other while the second path is lower than the first path; one end of the guiding wall is extended into the first path so that a curved turned segment is formed on the first path while a curved slot is formed at the guiding wall and corresponding to a rear end of the curved turned segment; an inclined segment is extended from the rear end of the curved turned segment and connected to the second path; a stopping wall is disposed outside the first path and extended to an outer side of connection area where the first path and the second path are connected; the stopping wall is provided with a stop projection convex toward the first path and corresponding to the curved slot for abutting against the elastic locking piece into the curved slot.

2. The pivoting shield assembly for hats as claimed in claim 1, wherein the pivot base is further provided with at least one mounting piece which is corresponding to the mounting slot of the hat for being mounted and connected to the mounting slot of the hat.

3. The pivoting shield assembly for hats as claimed in claim 2, wherein the first connecting rod and the second connecting rod are both curved connecting rods, or a combination of a curved connecting rod and a straight connecting rod.

4. The pivoting shield assembly for hats as claimed in claim 2, wherein the stopping wall at the outside of the first path is further provided with a plurality of protruding blocks corresponding to the elastic locking piece and the protruding blocks are used for limiting movement of the elastic locking piece in the first path.

5. The pivoting shield assembly for hats as claimed in claim 4, wherein the first connecting rod and the second connecting rod are both curved connecting rods, or a combination of a curved connecting rod and a straight connecting rod.

6. The pivoting shield assembly for hats as claimed in claim 1, wherein the stopping wall at the outside of the first path is further provided with a plurality of protruding blocks corresponding to the elastic locking piece and the protruding blocks are used for limiting movement of the elastic locking piece in the first path.

7. The pivoting shield assembly for hats as claimed in claim 1, wherein the first connecting rod and the second connecting rod are both curved connecting rods, or a combination of a curved connecting rod and a straight connecting rod.

* * * * *